US006132476A

United States Patent [19]

Lunsford et al.

[11] Patent Number: 6,132,476

[45] Date of Patent: Oct. 17, 2000

[54] FLAME AND SHRINKAGE RESISTANT FABRIC BLENDS AND METHOD FOR MAKING SAME

[75] Inventors: Clyde C. Lunsford, Sharpsburg, Ga.; Phillip H. Riggins, Greensboro, N.C.; Michael T. Stanhope, Atlanta, Ga.

[73] Assignee: Southern Mills, Inc., Union City, Ga.

[21] Appl. No.: 09/062,805

[22] Filed: Apr. 20, 1998

[51] Int. Cl.[7] ..... D06P 3/82; D06P 3/852

[52] U.S. Cl. ..... 8/531; 8/925; 442/136; 442/153; 442/164; 442/165

[58] Field of Search ..... 8/531, 925; 442/136, 442/153, 164, 169

[56] References Cited

U.S. PATENT DOCUMENTS

| | | | |
|---|---|---|---|
| 3,918,901 | 11/1975 | Ida et al. | 8/172 |
| 4,668,234 | 5/1987 | Vance et al. | 8/115 |
| 4,741,740 | 5/1988 | Davis et al. | 8/490 |
| 4,752,300 | 6/1988 | Johnson | 8/584 |
| 4,759,770 | 7/1988 | Cates et al. | 8/490 |
| 4,814,222 | 3/1989 | Davis et al. | 428/229 |
| 4,898,596 | 2/1990 | Riggins et al. | 8/490 |
| 4,902,300 | 2/1990 | Johnson et al. | 8/532 |
| 5,074,889 | 12/1991 | Hodge et al. | 8/602 |
| 5,174,790 | 12/1992 | Riggins et al. | 8/490 |
| 5,215,545 | 6/1993 | Cates et al. | 8/490 |
| 5,306,312 | 4/1994 | Riggins et al. | 8/586 |
| 5,447,540 | 9/1995 | Kobayashi et al. | 8/654 |
| 5,527,597 | 6/1996 | Stanhope et al. | 428/231 |
| 5,578,368 | 11/1996 | Forsten et al. | 428/229 |
| 5,694,981 | 12/1997 | Stanhope et al. | 139/383 R |

*Primary Examiner*—Blaine Copenheaver
*Assistant Examiner*—John J. Guarriello
*Attorney, Agent, or Firm*—Thomas, Kayden, Horstemeyer & Risley

[57] ABSTRACT

Fabric blends of inherently flame resistant fibers and flame resistant cellulosic fibers that contain a flame retardant. According to the method of production of these blends, the inherently flame resistant fibers can be dyed a full shade of color without depleting the flame retardant contained in the cellulosic fibers. In addition, the potential for laundering shrinkage of the inherently flame resistant fibers of the blends is reduced regardless of whether both, one of, or neither of the inherently flame resistant fibers and the flame resistant cellulosic fibers are dyed. Dyeing and/or shrinkage prevention of these blends is conducted at temperatures below 100° C., typically approximately between 70° C. and 100° C. Preferably, dye-assistants used in the process are selected from the group comprising N-cyclohexylpyrrolidone, benzyl alcohol, N,N-dibutylformamide, N,N-diethylbenzamide, hexadecyltrimethyl ammonium salt, N,N-dimethylbenzamide, N,N-diethyl-m-toluamide, N-octylpyrrolidone, aryl ether, an approximately 50/50 blend of N,N-dimethylcaprylamide and N,N-dimethylcapramide, and mixtures thereof.

30 Claims, No Drawings

FLAME AND SHRINKAGE RESISTANT FABRIC BLENDS AND METHOD FOR MAKING SAME

FIELD OF THE INVENTION

The present invention relates to flame resistant fabrics. More particularly, the present invention relates to dyed fabric blends containing inherently flame resistant fibers and flame resistant cellulosic fibers that contain a flame retardant compound. These dyed fabrics exhibit excellent flame resistance, minimal shrinkage when laundered, and can be produced in a full range of colors and shades. The process used to dye the fabric of the present invention effectively dyes the inherently flame resistant fibers, and simultaneously decreases the reduction in flame resistance of the cellulosic fibers while controlling laundry shrinkage of the inherently flame resistant fibers.

BACKGROUND OF THE INVENTION

Inherently flame resistant fibers are highly resistant to heat decomposition and are therefore desirable in the manufacture of flame resistant garments intended for environments in which flames or extreme heat will be encountered. These desirable properties of inherently flame resistant fibers can, however, create difficulties during fabric production. For example, fibers composed of aromatic polyamide, commonly known as aramid fibers, are difficult to dye. Aramid fiber suppliers have recommended complicated exhaust dyeing procedures with various dye-assistants, high temperatures, and long dyeing times to effect dyeing of these fibers. Such dyeing conditions require substantial amounts of energy both to maintain the dyeing temperature and for the treatment of waste dyebaths. Dye-assistants comprised of organic agents, and commonly referred to as carriers or swelling agents, are used to enhance dyeability. Such dye-assistants may be added to the dyebath as a treatment prior to dyeing, or can be integrated into the inherently flame resistant fiber during production.

Inherently flame resistant fibers such as aramid fibers can be blended with fibers made of other materials. As is known in the art, fiber blending can be used to obtain an end fabric that combines the beneficial characteristics of each of the constituent fibers. For instance, in the area of flame resistant fabric manufacture, flame resistant cellulosic fibers such as flame resistant rayon ("FR rayon") fibers can be successfully blended with aramid fibers to obtain a flame resistant material which is softer, more moisture absorbent, and less expensive to produce than materials constructed only of aramid fibers.

Although improving the texture and lowering the cost of flame resistant fabrics, blending inherently flame resistant fibers with flame resistant cellulosics such as FR rayon can complicate production. Specifically, cellulosics contain flame retardant agents that, although resistant to standard cellulosic dyeing procedures, tend to be depleted by the extreme temperatures generally considered necessary to dye the inherently flame resistant fibers. This depletion of flame retardant agents significantly reduces the flame resistance of the cellulosic fibers and therefore reduces the flame resistance of these blends. Moreover, these conditions increase the likelihood of further depletion of the flame retardant agents during subsequent launderings and an even greater reduction in flame resistance.

Due to the danger of depleting the flame retardant agent or agents contained in the cellulosic fibers of such fabric blends, producers of cellulosic fibers often advise their customers to avoid dyeing the inherently flame resistant fibers when blended with flame resistant cellulosic fibers. As an alternative, these producers suggest using producer colored inherently flame resistant fiber where a colored, flame resistant cellulosic blend is desired. In producer coloring (also known as "solution dyeing"), pigment or other coloring is typically injected into the polymer solution before the fiber is formed. Although providing for adequate colorization of these fibers, producer coloring presents several disadvantages. First, producer colored fibers usually are more expensive than non-producer colored fibers. Second, due to the increased difficulty and cost associated with the production of these fibers, typically only a limited variety of producer colored fibers are available.

Although dyeing at temperatures below 100° C. substantially reduces the depletion of flame retardant agents from the cellulosic fibers, such low temperature dyeing creates a further complication. Specifically, when conventional dyeing methods are used at temperatures below 100° C., not only do the inherently flame resistant fibers resist dyeing, these fibers become susceptible to substantial laundry shrinkage. Accordingly, if conventional piece-dyeing techniques are employed, the dyer is typically left with a choice between acceptable color and shrinkage control but unacceptable flame resistance on one hand (when dyeing above 100° C.), and preserved flame resistance but high laundering shrinkage and poor color yield on the other (when dying below 100° C.). Since neither option is commercially attractive, the industry preference for producer colored inherently flame resistant fibers in such blends is understandable.

From the above discussion, it can be appreciated that it would be desirable to have fabric blends comprising inherently flame resistant fibers and flame resistant cellulosic fibers in which the inherently flame resistant fibers have been dyed a full shade of color without depleting the flame retardant agent or agents contained in the cellulosic fiber, while simultaneously reducing the extent to which the fabric will shrink during laundering. Furthermore, it would be desirable to have a method for dyeing such fabric blends to achieve these properties.

SUMMARY OF THE INVENTION

The present invention provides fabric blends of inherently flame resistant fibers and flame resistant cellulosic fibers that contain a flame retardant compound. Preferably, both the cellulosic fibers and the inherently flame resistant fibers are dyed without significantly depleting the flame retardant compound contained in the cellulosic fibers while simultaneously ensuring that the resulting fabric is highly resistant to subsequent laundering shrinkage.

Although the inherently flame resistant fibers can be composed of any material that is inherently flame resistant, it is preferred that these fibers are made of an aromatic polyamide, polyamide imide, or polyimide, each of which is recognized in the art as being difficult to dye. Particularly preferred are fibers composed essentially of an aromatic polyamide such as meta-aramid or para-aramid. Although meta-aramid and para-aramid fibers share similar characteristics, there are significant differences between the two. Notably, meta-aramid fibers have a greater tendency to shrink when subjected to laundering than do para-aramid fibers. Accordingly, dyed meta-aramid blends must be produced in a manner in which subsequent shrinking that typically occurs during laundering is prevented or inhibited.

One or more of the above identified inherently flame resistant fibers is blended with one or more types of cellulosic fiber such as rayon, acetate, triacetate, and lyocell. Because these cellulosic fibers are not naturally resistant to flame, they typically are treated with one or more flame retardants when flame resistance is required. To prevent the excessive degradation of these retardants, dyeing is conducted at temperatures below 100° C. Typically, peak temperatures approximately between 70° C. and 100° C. are used, with 85° C. being most preferred.

Dyeing of the inherently flame resistant fibers contained in the fabric blends can be accomplished with one of several dye-assistants. During the dyeing process, the dye-assistant promotes the penetration of the inherently flame resistant fibers by the dye so that the fibers are changed in color. In that dyeing is conducted at relatively low temperatures, dye-assistants that adequately promote dyeing of inherently flame resistant fibers at low temperatures must be used. Additionally, where shrinkage resistance is desired, the selected dye-assistant must further limit subsequent shrinkage caused by laundering. Preferably, this dye-assistant will be selected from the group consisting of N-cyclohexylpyrrolidone, benzyl alcohol, N,N-dibutylformamide, N,N-diethylbenzamide, hexadecyltrimethyl ammonium salt, N,N-dimethylbenzamide, N,N-diethyl-m-toluamide, N-octylpyrrolidone, aryl ether, Halcomid M-8/10 (an approximately 50/50 blend of N,N-dimethylcaprylamide and N,N-dimethylcapramide), and mixtures thereof. Where the greatest shrinkage control is desired, most preferred is a dye-assistant selected from the group consisting of N-cyclohexylpyrrolidone, benzyl alcohol, N,N-dibutylformamide, and mixtures thereof.

In situations in which both the cellulosic and inherently flame resistant fibers of the fabric blend are to be dyed, the cellulosic fibers are first dyed in a conventional manner, such as by exhaust dyeing. After these fibers have been adequately dyed, the inherently flame resistant fibers of the fabric can be dyed in the manner described above. Normally, the temperature of the dyebath is gradually increased from room temperature to a peak temperature approximately between 70° C. and 100° C. The dyebath is maintained at its peak temperature for approximately between 30 to 90 minutes to permit the dye to penetrate the inherently flame resistant fibers.

DETAILED DESCRIPTION OF THE INVENTION

As summarized above, the present invention provides fabric blends of inherently flame resistant fibers and flame resistant cellulosic fibers that contain a flame retardant compound. Typically, the inherently flame resistant fibers, the flame resistant cellulosic fibers, or both are dyed through an exhaust process. Through the method of the present invention, the inherently flame resistant fibers of the fabric can be dyed a full shade of color without significantly depleting the amount of flame retardant compound contained in the cellulosic fibers to preserve the flame resistance of the fabric after the dyeing process is completed and through subsequent laundering. It is to be noted that, for the purposes of this disclosure, the term full shade denotes penetration of the subject fiber with dye and fixation of the dye therein, as opposed to mere superficial staining of the fibers. In addition to flame retardant retention, shrinkage of the inherently flame resistant fibers is reduced through the present method such that the overall fabric shrinkage is within levels considered acceptable by industry standards.

Although the inherently flame resistant fibers can be composed of any material that is inherently flame resistant, it is preferred that these fibers are composed essentially of an aromatic polyamide, polyamide imide, or polyimide, each of which is considered difficult to dye. Most preferably, these fibers will be composed essentially of an aromatic polyamide. Aromatic polyamides are formed by reactions of aromatic diacid chlorides with aromatic diamines to produce amide linkages in an amide solvent. Fibers made of aromatic polyamides are generally referred to by the generic term aramid fiber. Aramid fibers are typically available in two distinct compositions, namely meta-type fibers composed of poly(m-phenylene isophthalamide) commonly referred to as meta-aramid fibers, and para-type fibers composed of poly (p-phenyleneterephthalamide) which are commonly referred to as para-aramid fibers. Meta-aramid fibers are currently available from DuPont of Wilmington, Del. in several forms under the trademark NOMEX®. For example, NOMEX T-450® is 100% meta-aramid; NOMEX T-455® is a blend of 95% NOMEX® and 5% KEVLAR® (para-aramid); and NOMEX IIIA® (also known as NOMEX T-462®) is 93% NOMEX®, 5% KEVLAR®, and 2% carbon core nylon. In addition, meta-aramid fibers are available under the trademarks CONEX® and APYEIL® which are produced by Teijin and Unitika, respectively. Para-aramid fibers are currently available under the trademarks KEVLAR®, TECHNORA®, and TWARON® from DuPont, Teijin, and Akzo respectively. In accordance with the above description, it is to be noted that, in the present disclosure, when a material name is followed by the term "fiber," the fiber described is not limited to fibers composed exclusively of the named material.

Meta-aramid and para-aramid fibers share similar characteristics. For instance, both have limiting oxygen indexes (LOI's) approximately between 24 and 30 percent. However, there are significant differences between the two compositions. Notably, para-aramid fibers are considerably stronger than meta-aramid fibers, having tenacity values approximately between 21–27 g/d and a tensile strength of about 400 psi. This strength makes para-aramid fibers particularly useful in law enforcement and military applications. Another significant distinction between meta-aramid and para-aramid fibers is that, although both are difficult to dye, meta-aramid fibers appear to more readily accept dye during the dyeing procedure. Despite being easier to dye, meta-aramid fibers have a greater tendency to shrink when subjected to laundering than do para-aramid fibers. Accordingly, dyed meta-aramid blends must be produced in a manner which additionally prevents or inhibits subsequent shrinking due to laundering.

Another group of fibers that have flame resistant properties and that are difficult to dye are polyamide imides. Sometimes referred to as an aromatic polyamide, polyamide imide is a high performance thermoplastic that is the condensation polymer of trimellitic anhydride and various diamines. Polyamide imide fibers are currently available under the trademark KERMEL® which is produced by Rhône-Poulenc.

A further group of fibers that have flame resistant properties and that are difficult to dye are polyimides. Polyimide is chemically known as poly(4.4'-diphenylmethane-co-tolylenebenzophenonetetracarboxylicimide) and is made by the reaction of benzophenone tetra carboxylic anhydride with a mixture of tolylene and diphenylmethane diisocyanates in a polar aprotic solvent such as dimethyl-formamide or acetamide. Polyimide fibers are currently available from Lenzing under the trademark P-84®.

In the present invention, one or more of the above identified inherently flame resistant fibers is blended with one or more types of cellulosic fiber. Preferred for the choice of cellulosic fibers are rayon, acetate, triacetate, and lyocell. These cellulosics, although softer and less expensive than the inherently flame resistant fibers, are not naturally resistant to flame. To increase the flame resistance of these fibers, they typically are treated with one or more flame retardants such as phosphorus compounds like SANDOLAST 9000®, currently available from Sandoz, antimony compounds, and the like. Generally speaking, cellulosic fibers which contain one or more flame retardants are given the designation "FR". Accordingly, the preferred flame resistant cellulosic fibers are FR rayon, FR acetate, FR triacetate, and FR lyocell.

Of the many blends conceivable with the above described listing of preferred fibers, most preferred is a blend of NOMEX IIIA and FR rayon having a percentage composition of NOMEX IIIA® of at least 20% and a percentage composition of FR rayon of at least 10%. Typically, the fabric will comprise a 50/50, 65/35, or a 35/65 blend of NOMEX IIIA® and FR rayon.

The fabric of the present invention can be dyed using customary dyeing equipment. Typically, a dye, a dye-assistant, and a flame retardant for the inherently flame resistant fibers, are combined to form a mixture, (e.g., a dyebath, solution, dispersion, or the like). The fabric is then contacted with this mixture, typically by immersion, and the mixture heated until the dye is fixed in the inherently flame resistant fibers. In accordance with the present invention, a fibrous textile material, e.g., fiber web, yarn, thread, sliver, woven fabric, knitted fabric, non-woven fabric, or the like, is placed in the dyebath with the dyes and other additives using conventional equipment such as dye jets or other appropriate equipment.

The preferred dye-assistants of the present invention are selected from the group consisting of N-cyclohexylpyrrolidone, benzyl alcohol, N,N-dibutylformamide, N,N-diethylbenzamide, hexadecyltrimethyl ammonium salt, N,N-dimethylbenzamide, N,N-diethyl-m-toluamide, N-octylpyrrolidone, aryl ether, Halcomid M-8/10 (an approximately 50/50 blend of N,N-dimethylcaprylamide and N,N-dimethylcapramide), and mixtures thereof. Where the highest degree of shrinkage prevention is desired, the dye-assistant most preferably is selected from the group consisting of N-cyclohexylpyrrolidone, benzyl alcohol, N,N-dibutylformamide, and mixtures thereof.

As an alternative to adding dye-assistant to the dyebath, the dye-assistant can instead be imbibed into the fibers themselves during production. Exemplary of the types of fibers that could be used in this manner are those disclosed by Vance et al. in U.S. Pat. No. 4,688,234, and Hodge et al. in U.S. Pat. No. 5,074,889, both of which are hereby incorporated by reference. As disclosed by Vance et al., typically a surfactant such as hexadecyltrimethylammonium salt or isopropylammonium dodecylbenzenesulfonate is added to the fiber at a level of approximately 5% to 15% by weight. When the fibers are imbibed with dye-assistant, dyeing is conducted in the same manner as described above except that no additional dye-assistant need be added to the dyebath.

In addition to the dye-assistants, a flame retardant compound can also be included in the dyebath, applied as an after dyeing surface treatment, or otherwise incorporated in the fiber to enhance flame resistance or to counteract any deleterious effects of the dye-assistant contained within the inherently flame resistant fibers. Preferred flame retardants are ANTIBLAZE 80® ("AB80®") and ANTIBLAZE 100® ("AB100®") which are both currently available from Albright & Wilson.

Dyes that can be used advantageously with the present carriers for the dyeing of the inherently flame resistant fibers can include anionic, cationic, disperse dyes, and mixtures thereof. Of these dyes, particularly preferred are cationic dyes. With regard to the dyeing of the cellulosic fibers, preferred are reactive, vat, and sulfur, with reactive dyes being most preferred.

As described above, dyeing blends of inherently flame resistant fibers and flame resistant cellulosic fibers has, heretofore, been inadvisable because the dyeing conditions normally used adversely affect one or both types of the fibers. In particular, the high temperatures conventionally deemed necessary to attain adequate dyeing and shrinkage control of the inherently flame resistant fibers deplete the flame retardant contained in the cellulosic fibers. Notably, this depletion generally is not remedied by the inclusion of is additional flame retardant in the dyebath under conventional conditions. Furthermore, these conventional dyeing conditions cause increased subsequent depletion of flame retardant when the fabric blends are laundered. Under the method of the instant invention, however, effective dyeing of the inherently flame resistant fibers can be attained at temperatures below approximately 100° C., without a substantial loss of cellulosic flame retardant and without losing shrinkage control. Typically, temperatures approximately between 70° C. and 100° C. are used with approximately 85° C. being most preferred. It will be appreciated, however from the data provided below, that temperatures as low as 60° C. and even 50° C. can be used to dye the blends. However, in that the dyeing process is less efficient and shrinkage prevention more difficult at these lower temperatures, usually temperatures between the stated 70° C.–100° C. range are used.

To conduct dyeing of the inherently flame resistant fibers of the blends, a dye-assistant, a dye, and other additives if desired, are preferably applied to the fibers of the fabric using a one-step batch-type process, although split treatment with dye-assistants applied separately from the dye is feasible, and in some applications might be desirable. Typically a roll of fabric is loaded into a jet dyer such as a pressure jet dyeing vessel in which the fabric can be circulated through a apertured venturi contained within the vessel. Once loaded into the vessel, the ends of the fabric are sewn together to form a continuous loop. The fabric is then scoured by passing it through an aqueous solution that passes through the apertures in the venturi and impinges the fabric. After scouring has been completed, the jet is again charged with water, the selected dye-assistant and dye, and any other auxiliary additives that are desired. Alternatively, where dye-assistant has been imbibed into the fibers, no additional dye-assistant is added to the dyebath since an adequate amount of dye-assistant is typically already contained within the fibers themselves. In such circumstances, the same dye steps apply with the exception of the step of adding dye-assistant to the dyebath.

The temperature of the dyebath is gradually increased from room temperature to a peak temperature approximately between 70° C. and 100° C. This gradual increase in temperature is customary in the industry, and is thought to promote even and uniform coloration. Upon reaching the predetermined peak temperature, the dyebath is maintained at this peak temperature for about 30 to 90 minutes to allow dye to fully penetrate the fibers. It will be appreciated that since the dyeing temperature range does not reach 100° C., there is no need to increase the pressure of the dyebath beyond atmospheric pressure to prevent boiling. Therefore, all dyeing can be conducted at constant ambient atmospheric pressure, although a closed vessel and increased pressure may be used to reduce foaming or control odors.

After the expiration of approximately between 30 to 90 minutes at the peak temperature, the dyebath is cooled until the fabric is at a temperature at which it can be handled. At this time, the dyebath is discarded and the fabric is again scoured to remove excess dye-assistant or other chemicals contained in the inherently flame resistant fibers. After all dyeing has been completed, the fabric then can be finished in the conventional manner. This finishing process can include the application of wicking agents, water repellents, stiffening agents, softeners, and the like. At this stage, the finished fabric normally contains residual dye-assistant in a concentration of approximately 0.5% to 10% owf, depending on the dye-assistant used and total processing. Typically, it is preferred to keep the levels of residual dye-assistants in the lower portion of the range, approximately between 0.5% and 5.0% owf.

Illustrative of the beneficial results attainable when dyeing at low temperatures as compared with dyeing at high temperatures, Table I provides phosphorous compound retention data for identical samples of a 75/25 blend of NOMEX T-462® and FR rayon that were separately dyed at 250° F. (~121° C.) and 185° F. (85° C.). As evidenced by these test data, much larger amounts of phosphorus compound are retained when dyeing at 185° F. as opposed to 250° F., especially after repeated industrial launderings conducted in accordance with NFPA 1975, 1994 ed., s. 4-2.4 as described in the publication entitled *Standard of Station/Work Uniforms for Fire Fighters,* 1994 edition, which is hereby incorporated by reference.

TABLE I

PHOSPHORUS RETENTION

| Dye-Assistant | Peak Dye Temperature | Phosphorus Concentration* After Launderings 0 | 25 | 50 | 75 | 100 |
|---|---|---|---|---|---|---|
| benzyl alcohol | 250° F.(~121° C.) | 0.66 | 0.59 | 0.51 | 0.35 | 0.36 |
| aryl ether | 250° F.(~121° C.) | 0.54 | 0.47 | 0.29 | 0.44 | 0.25 |
| none (water) | 250° F.(~121° C.) | 0.76 | 0.63 | 0.52 | 0.43 | 0.34 |
| aryl ether | 185° F.(85° C.) | 0.77 | 0.70 | 0.64 | 0.65 | 0.61 |
| N-cyclohexyl-pyrrolidone | 185° F.(85° C.) | 0.74 | 0.66 | 0.65 | 0.62 | 0.61 |
| none (water) | 185° F.(85° C.) | 0.77 | 0.70 | 0.70 | 0.67 | 0.67 |

*Phosphorus concentration was determined by inductively coupled plasma - atomic mission spectroscopy hydrochloric acid digestion of samples.

As shown in Table II, phosphorus retention is maintained when dyeing according to the present invention even at temperatures approaching 100° C. In group A, identical samples of a 65/35 T-462® blend of NOMEX and FR rayon were union dyed at 210° F. (~99° C.) for 60 minutes using N-cyclohexylpyrrolidone as a dye-assistant. In group B, the samples were union dyed under the same conditions but for 90 minutes at a peak temperature of 210° F. In samples 1–4 of each group, 3 g/l of AB80® were added to the dyebath. All samples were also laundered 100 times in accordance with NFPA 1975, 1994 ed., s. 4–2.4. As is evident from these data, phosphorous concentrations stayed above 0.5% when dyed for either 60 or 90 minutes regardless of whether AB80® was added to the dyebath or not.

TABLE II

PHOSPHORUS RETENTION
(Peak Dyeing Temp. = 210° F.(~99° C.))

| Sample No. | Amt. of Dye-Assistant Used (g/l) | Phosphorus Concentration (%) |
|---|---|---|
| | Group A: 60 min. peak dye time | |
| 1 | 30 | 0.82 |
| 2 | 35 | 0.82 |
| 3 | 40 | 0.74 |
| 4 | 45 | 0.81 |
| 5 | 30 | 0.55 |
| 6 | 35 | 0.58 |
| 7 | 40 | 0.55 |
| 8 | 45 | 0.54 |
| | Group B: 90 min. peak dye time | |
| 1 | 30 | 0.77 |
| 2 | 35 | 0.80 |
| 3 | 40 | 0.84 |
| 4 | 45 | 0.78 |
| 5 | 30 | 0.65 |
| 6 | 35 | 0.68 |
| 7 | 40 | 0.60 |
| 8 | 45 | 0.60 |

Testing has shown that blends of inherently flame resistant fibers and flame resistant cellulosic fibers must have a phosphorus concentration of at least approximately 0.5% owf to remain adequately flame resistant in accordance with FTMS 191A Method 5903.1 as described in the publication entitled *FTMS Textile Test Methods,* 1978 edition, which is hereby incorporated by reference. According to Method 5903.1, a three inch by twelve inch fabric specimen is placed in a holder and is suspended vertically over a 1½ inch high methane gas flame. During the test, the material is placed in contact with the flame at the flame's mid-point for a period of twelve seconds. After expiration of the twelve seconds, the flame is extinguished and the material observed to, inter alia, determine how long it will continue to burn. This duration of burning after extinguishment of the methane flame is referred to as "afterflame." Presently deemed acceptable under military and NFPA standards are afterflame durations of 2.0 seconds and less.

Tables III and IV provided below illustrate the criticality of the 0.5% owf measure of phosphorus retention on afterflame control. The data in Table III was obtained by dyeing identical samples of 75/25 blends of NOMEX® and FR rayon with the various listed dye-assistants at 250° F. (note that "CHP" stands for N-cyclohexylpyrrolidone and "BPP" stands for emulsified butyl/propylphthalimide). After dyeing, the samples were industrially laundered 0, 25, 75, or 100 times in accordance with NFPA 1975, 1994 ed., s. 4-2.4, and then exposed to flame in accordance with test method FTSM 5903.1 for three seconds instead of twelve. Although only providing a three second exposure to flame, it is believed that the three second flame exposure is a more critical indicator of fabric performance than the twelve second exposure of FTMS 5903.1. In particular, the twelve second duration provides greater opportunity of flame extinguishment (see Table IV). Additionally, the twelve second flame exposure period does not reflect the fabric's resistance to flash fires which typically inflict damage primarily within the first three to four seconds. Under the three second exposure test, afterflames greater than 0.8 seconds provide cause for concern in that afterflames that exceed 0.8 seconds indicate an increased likelihood of injury to the fabric wearer. As is evident from the data of Table II, afterflames greater than 0.8 seconds are consistently avoided when the phosphorus concentrations of the fabric is at least approximately 0.5% owf.

TABLE III

AFTERFLAME RELATIVE TO PHOSPHORUS RETENTION (Three Second Exposure)

| Dye-Assistant | No. of Launderings | Phosphorus Concentration (%) | Afterflame (sec) |
|---|---|---|---|
| none (water) | 0 | 0.76 | 0.1 |
| aryl ether | 0 | 0.54 | 0.8 |
| acetophenone | 0 | 0.59 | 0.5 |
| CHP | 0 | 0.69 | 0.5 |
| benzyl alcohol | 0 | 0.66 | 0.4 |
| BPP | 0 | 0.78 | 0.4 |
| none (water) | 25 | 0.63 | 0.4 |
| aryl ether | 25 | 0.47 | 0.5 |
| acetophenone | 25 | 0.42 | 0.4 |
| CHP | 25 | 0.49 | 0.5 |
| benzyl alcohol | 25 | 0.59 | 0.4 |
| BPP | 25 | 0.35 | 0.4 |
| none (water) | 50 | 0.52 | 0.4 |
| aryl ether | 50 | 0.29 | 3.5 |
| acetophenone | 50 | 0.35 | 0.6 |
| CHP | 50 | 0.38 | 0.6 |
| benzyl alcohol | 50 | 0.51 | 0.4 |
| BPP | 50 | 0.42 | 1.1 |
| none (water) | 75 | 0.43 | 0.6 |
| aryl ether | 75 | 0.44 | 0.6 |
| acetophenone | 75 | 0.30 | 29.8 |
| CHP | 75 | 0.39 | 0.6 |
| benzyl alcohol | 75 | 0.35 | 1.0 |
| BPP | 75 | 0.44 | 0.9 |
| none (water) | 100 | 0.34 | 0.7 |
| aryl ether | 100 | 0.25 | 4.0 |
| acetophenone | 100 | 0.25 | 24.1 |
| CHP | 100 | 0.37 | 1.1 |
| benzyl alcohol | 100 | 0.36 | 0.8 |
| BPP | 100 | 0.30 | 2.6 |

Table IV provides afterflame data of the same fabric and dye-assistants tested in Table III, but after twelve seconds of exposure to flame in accordance with FTMS 5903.1.

TABLE IV

AFTERFLAME RELATIVE TO PHOSPHORUS RETENTION (Twelve Second Exposure)

| Dye-Assistant | No. of Launderings | Phosphorus Concentration (%) | Afterflame (sec) |
|---|---|---|---|
| none (water) | 0 | 0.76 | N/A |
| aryl ether | 0 | 0.54 | 0.0 |
| acetophenone | 0 | 0.59 | 0.0 |
| CHP | 0 | 0.69 | 0.0 |
| benzyl alcohol | 0 | 0.68 | 0.0 |
| BPP | 0 | 0.78 | 0.0 |
| none (water) | 25 | 0.63 | 0.0 |
| aryl ether | 25 | 0.47 | 0.2 |
| acetophenone | 25 | 0.42 | 0.0 |
| CHP | 25 | 0.49 | 0.0 |
| benzyl alcohol | 25 | 0.59 | 0.0 |
| BPP | 25 | 0.35 | 0.0 |
| none (water) | 50 | 0.52 | 0.0 |
| aryl ether | 50 | 0.29 | 0.0 |
| acetophenone | 50 | 0.35 | 0.0 |
| CHP | 50 | 0.38 | 0.0 |
| benzyl alcohol | 50 | 0.51 | 0.0 |
| BPP | 50 | 0.42 | 0.0 |
| none (water) | 75 | 0.43 | 0.0 |
| aryl ether | 75 | 0.44 | 0.0 |
| acetophenone | 75 | 0.30 | 16.1 |
| CHP | 75 | 0.39 | 0.0 |
| benzyl alcohol | 75 | 0.35 | 0.0 |
| BPP | 75 | 0.44 | 0.0 |

TABLE IV-continued

AFTERFLAME RELATIVE TO PHOSPHORUS RETENTION (Twelve Second Exposure)

| Dye-Assistant | No. of Launderings | Phosphorus Concentration (%) | Afterflame (sec) |
|---|---|---|---|
| none(water) | 100 | 0.34 | 0.0 |
| aryl ether | 100 | 0.25 | 0.0 |
| acetophenone | 100 | 0.25 | 13.9 |
| CHP | 100 | 0.37 | 0.0 |
| benzyl alcohol | 100 | 0.36 | 0.0 |
| BPP | 100 | 0.30 | 0.0 |

Taking into account fabric composition, it has been determined that a phosphorus compound concentration of approximately 0.5% owf translates into a phosphorus concentration of at least approximately 1.4% phosphorus by weight of cellulosic fiber component. In that it is desired to have a fabric which is adequately flame resistant even after extensive laundering, where phosphorus compound is used as the flame retardant contained in the cellulosic fibers it is preferred that the resultant blends have a phosphorus concentration of at least approximately 1.4% phosphorus by weight of cellulosic fiber component after 100 launderings conducted in accordance with NFPA 1975, 1994 ed., s. 4-2.4.

As described above, high temperatures are typically needed and used for dyeing inherently flame resistant fibers. However, as illustrated in Table I, such high temperatures deplete the flame retardants contained in the cellulosic fibers resulting in reduced flame resistance of the fabric blend. Accordingly, the dye-assistant used must promote dyeing of the inherently flame resistant fibers at relatively low temperatures. With this consideration in mind, additional testing was conducted with NOMEX®/FR rayon blends at low temperature to determine the degree of shade depth attainable when dyeing with a variety of alternative dye-assistants. Using several identical samples of a 65/35 blend of NOMEX IIIA® and FR rayon fibers and a laboratory launderometer dye apparatus, ten separate dyeing trials were made, each with a different dye-assistant (see Table V). In each trial, the launderometer tube was loaded at a 10:1 liquor ratio with the dyebath containing 2.8% basic blue dye C.I. #41 owf and 40 g/l of the particular dye-assistant being tested (water was used as a control in the last trial). Dyeing was conducted at 85° C. for 60 minutes. Shade depth was measured terms of the lightness or L value of the standardized L,a,b scale. In accordance to this scale, the smaller the value of the L parameter, the deeper the shade, and therefore the greater the extent of dyeing achieved. As indicated in Table V, each of N-cyclohexylpyrrolidone, benzyl alcohol, N,N-dibutylformamide, N,N-diethyl-m-toluamide, aryl ether, N-octylpyrrolidone, and N,N-dimethylbenzamide provided a deep shade of dyeing.

TABLE V

SHADE DEPTH (Peak Dyeing Temp. = 85° C.)

| Dye-Assistant | Shade Depth (L) |
|---|---|
| N-cyclohexylpyrrolidone | 27.84 |
| N,N-diethyl-m-toluamide | 28.30 |
| *aryl ether | 27.93 |
| N-octylpyrrolidone | 27.80 |
| N,N-dibutylformamide | 28.22 |
| butylbenzesulfonamide | 36.20 |

TABLE V-continued

| SHADE DEPTH (Peak Dyeing Temp. = 85° C.) | |
|---|---|
| Dye-Assistant | Shade Depth (L) |
| benzyl alcohol | 26.98 |
| N,N-dimethylbenzamide | 29.06 |
| sodium xylene sulfonate | 36.75 |
| water | 33.85 |

*Aryl ether dye-assistants are commercially available from Miles, Hickson Dan Chem, or Stockhausen as proprietary products.

As identified above, acceptable dyeing can be achieved with temperatures below 85° C. Tables VI, VII, and VIII illustrate the depths of shade attainable with dyeing at 50° C., 60° C., and 70° C., respectively. In each trial, identical samples of 100% NOMEX IIIA® were dyed with no more than 40 g/l of the selected dye-assistant present.

TABLE VI

| SHADE DEPTH (Peak Dyeing Temp. = 50° C.) | |
|---|---|
| Dye-Assistant | Shade Depth (L) |
| N-cyclohexylpyrrolidone | 41.55 |
| benzyl alcohol | 29.38 |
| N,N-dibutylformamide | 40.92 |
| N,N-diethyl-m-toluamide | 39.04 |
| N,N-diethylbenzamide | 38.20 |
| acetophenone | 39.89 |

TABLE VII

| SHADE DEPTH (Peak Dyeing Temp. = 60° C.) | |
|---|---|
| Dye-Assistant | Shade Depth (L) |
| N-cyclohexylpyrrolidone | 34.68 |
| benzyl alcohol | 27.80 |
| N,N-dibutylformamide | 35.84 |
| N,N-diethyl-m-toluamide | 38.69 |
| N,N-diethylbenzamide | 33.83 |
| acetophenone | 31.32 |

TABLE VIII

| SHADE DEPTH (Peak Dyeing Temp. = 70° C.) | |
|---|---|
| Dye-Assistant | Shade Depth (L) |
| N-cyclohexylpyrrolidone | 22.62 |
| benzyl alcohol | 20.35 |
| N,N-dibutylformamide | 25.42 |
| N,N-diethyl-m-toluamide | 33.45 |
| N,N-diethylbenzamide | 23.42 |
| acetophenone | 21.09 |

In addition to permitting deep coloration of the inherently flame resistant fibers, the method of the present invention reduces the shrinkage of the inherently flame resistant fibers and therefore fabric blends containing such fibers. Table IX provides shrinkage data for 65/35 blends of NOMEX IIIA® and FR rayon fibers dyed with 40 g/l of various carriers at 85° C. for 60 minutes. Each fabric sample was then subjected to 5, 10, and 20 AATCC Test Method 135-1992, Table I(3)(V)(A)(iii) launderings as described in the publication entitled *American Association of Textile Chemists and Colorists,* 1992 edition, which is hereby incorporated by reference. As is evident from Table IX, the least amount of shrinkage occurred when the dye-assistant used was N-cyclohexylpyrrolidone, benzyl alcohol, and N,N-dibutylformamide, with the warp direction of the fabric only shrinking 3.8%, 5.7%, and 6.6% after 20 launderings.

TABLE IX

| FABRIC SHRINKAGE (Peak Dyeing Temp. = 85° C.) | | | | | | |
|---|---|---|---|---|---|---|
| | Fill Shrinkage (%) | | | Warp Shrinkage (%) | | |
| Dye-Assistant | 5× | 10× | 20× | 5× | 10× | 20× |
| N-cyclohexylpyrrolidone | 1.5 | 2.1 | 2.1 | 3.0 | 3.5 | 3.8 |
| N,N-diethyl-m-toluamide | 4.1 | 6.1 | 7.1 | 5.1 | 7.8 | 9.7 |
| aryl ether | 4.6 | 7.1 | 10.2 | 5.1 | 9.1 | 12.6 |
| N,N-octylpyrrolidone | 4.1 | 5.6 | 7.7 | 5.1 | 7.5 | 10.2 |
| N,N-dibutylformamide | 2.1 | 3.1 | 3.1 | 3.0 | 4.9 | 5.7 |
| butylbenzesulfonamide | 6.2 | 7.7 | 11.8 | 7.5 | 11.2 | 18.7 |
| benzyl alcohol | 1.0 | 3.1 | 4.7 | 2.7 | 4.9 | 6.6 |
| N,N-dimethylbenzamide | 4.1 | 7.1 | 9.6 | 6.5 | 9.7 | 12.4 |
| sodium xylene sulfonate | 5.6 | 8.6 | 12.7 | 7.4 | 11.9 | 16.1 |
| water | 5.6 | 8.2 | 12.2 | 7.2 | 11.7 | 15.9 |

Table X provides shrinkage data for identical samples of 100% NOMEX IIIA® fabric at 70° C. for 60 minutes. After dyeing, each sample was laundered 5, 10, and 20 times in accordance with AATCC Test Method 135-1992, Table I(3)(V)(A)(iii). As shown in this table, commercially acceptable shrinkage control is obtainable at temperatures as low as 70° C.

TABLE X

| FABRIC SHRINKAGE (Peak Dyeing Temp. = 70° C.) | | | | | | |
|---|---|---|---|---|---|---|
| | Fill Shrinkage (%) | | | Warp Shrinkage (%) | | |
| Dye-Assistant | 5× | 10× | 20× | 5× | 10× | 20× |
| N-cyclohexylpyrrolidone (30 g/l) | 3.4 | 5.2 | 8.2 | 5.9 | 7.3 | 11.4 |
| N-cyclohexylpyrrolidone (40 g/l) | 4.1 | 5.2 | 9.3 | 5.2 | 7.5 | 12.4 |
| benzyl alcohol (30 g/l) | 3.3 | 4.9 | 8.0 | 4.9 | 6.7 | 11.1 |
| benzyl alcohol (40 g/l) | 4.1 | 5.2 | 8.2 | 4.1 | 6.4 | 10.3 |
| N,N-dibutylformamide (40 g/l) | 5.7 | 7.7 | 12.9 | 7.2 | 10.1 | 16.0 |

Although the shrinkage data provided above in Tables IX and X pertain specifically to shrinkage after dyeing the inherently flame resistant fibers, it is to be noted that the shrinkage of the inherently flame resistant fibers of these fabric blends can be controlled without actually dyeing the fibers. For instance, if a blend having just the cellulosic fibers dyed (or no fibers dyed) were desired, the dyeing process described above would be followed with the exception that for the inherently flame resistant fibers would not be included in the dyebath or other medium. Similarly, just the inherently flame resistant fibers of the blend could be dyed according to the present method, if desired.

The results of Tables I–X illustrate that blends of inherently flame resistant fibers such as aromatic polyamides, polyamide imides, and polyimides, and cellulosic fibers such as rayon, acetate, triacetate, and lyocell that contain a flame retardant compound can be effectively dyed such that the inherently flame resistant fibers are dyed a full shade of color (including deep shades, if desired), and the amount of flame retardant compound contained in the cellulosic fibers substantially maintained such that there is not a significant loss of flame resistance in the end fabric. Moreover, these results show that where inherently flame resistant fibers are susceptible to laundering shrinkage, dyeing or shrinkage inhibiting according to the present invention significantly reduces such shrinkage.

In the specification and examples, there have been disclosed preferred embodiments of the invention, although specific terms are employed, they are used in a generic and descriptive sense only and not for the purpose of limitation, the scope of the invention being defined by the following claims.

What is claimed is:

1. A dyed flame resistant fabric comprising:

a plurality of inherently flame resistant fibers; and a plurality of cellulosic fibers containing a flame retardant compound;

wherein said inherently flame resistant fibers have been dyed a full shade of color due to the dyeing of said fabric;

wherein said flame retardant is a phosphorus compound contained in said fabric in a concentration of at least approximately 1.4% phosphorus by weight of cellulosic fiber component after 100 launderings conducted in accordance with NFPA 1975, 1994 ed., s. 4-2.4.

2. The dyed flame resistant fabric of claim 1, wherein said inherently flame resistant fibers are essentially composed of a material selected from the group consisting of aromatic polyamide, polyamide imide, polyimide, and mixtures thereof.

3. The dyed flame resistant fabric of claim 1, wherein said inherently flame resistant fibers are meta-aramid fibers.

4. The dyed flame resistant fabric of claim 1, wherein said cellulosic fibers are essentially composed of rayon, acetate, triacetate, lyocell, or mixtures thereof.

5. The dyed flame resistant fabric of claim 1, wherein said cellulosic fibers are rayon fibers.

6. The dyed flame resistant fabric of claim 1, wherein said dyed flame resistant fabric contains a residual amount of dye-assistant that remains in said fibers after said fabric has been dyed, said dye-assistant being selected from the group consisting of N-cyclohexylpyrrolidone, benzyl alcohol, N,N-dibutylformamide, and mixtures thereof.

7. The dyed flame resistant fabric of claim 1, wherein said fabric exhibits a duration of afterflame no greater than 2.0 seconds when subjected to a vertical flammability test conducted in accordance with FTMS 191A Method 5903.1 after previously being subjected to 100 launderings in accordance with NFPA 1975, 1994 ed., s. 4-2.4.

8. The dyed flame resistant fabric of claim 1, wherein said fabric exhibits a shrinkage percentage of no greater than approximately 7% after 20 launderings conducted in accordance with AATCC Test Method 135-1992, Table I (3)(V)(A)(iii).

9. The dyed flame resistant fabric of claim 1, wherein said inherently flame resistant fibers of said fabric have been dyed a shade of color which would result in an L value between approximately 18 and the greige L value for said fabric if said inherently flame resistant fibers were used to form a fabric composed exclusively of said inherently flame resistant fibers.

10. A dyed flame resistant fabric comprising:

a plurality of inherently flame resistant fibers; and a plurality of cellulosic fibers containing a flame retardant compound;

wherein said inherently flame resistant fibers have been dyed a full shade of color due to the dyeing of said fabric;

wherein said dyed flame resistant fabric exhibits a duration of afterflame no greater than 2.0 seconds when subjected to a vertical flammability test conducted in accordance with FTMS 191A Method 5903.1 using a three second exposure after previously being subjected to 100 launderings in accordance with NFPA 1975, 1994 ed., s. 4-2.4.

11. The dyed flame resistant fabric of claim 10, wherein said inherently flame resistant fibers are essentially composed of a material selected from the group consisting of aromatic polyamide, polyamide imide, polyimide, and mixtures thereof.

12. The dyed flame resistant fabric of claim 10, wherein said inherently flame resistant fibers are meta-aramid fibers.

13. The dyed flame resistant fabric of claim 10, wherein said cellulosic fibers are essentially composed of rayon, acetate, triacetate, lyocell, or mixtures thereof.

14. The dyed flame resistant fabric of claim 10, wherein said cellulosic fibers are rayon fibers.

15. The dyed flame resistant fabric of claim 10, wherein said dyed flame resistant fabric contains a residual amount of dye-assistant that remains in said fibers after said fabric has been dyed, said dye-assistant being selected from the group consisting of N-cyclohexylpyrrolidone, benzyl alcohol, N,N-dibutylformamide, and mixtures thereof.

16. The dyed flame resistant fabric of claim 10, wherein said fabric exhibits a shrinkage percentage of no greater than approximately 7% after 20 launderings conducted in accordance with AATCC Test Method 135-1992, Table I (3)(V)(A)(iii).

17. The dyed flame resistant fabric of claim 10, wherein said inherently flame resistant fibers of said fabric have been dyed a shade of color which would result in an L value between approximately 18 and the greige L value for said fabric if said inherently flame resistant fibers were used to form a fabric composed exclusively of said inherently flame resistant fibers.

18. A dyed flame resistant fabric comprising:

a plurality of inherently flame resistant fibers; and a plurality of cellulosic fibers containing a flame retardant compound;

wherein said inherently flame resistant fibers have been dyed a full shade of color due to the dyeing of said fabric;

wherein said dyed flame resistant fabric exhibits a shrinkage percentage of no greater than approximately 7% after 20 launderings conducted in accordance with AATCC Test Method 135-1992, Table I (3)(V)(A)(iii).

19. The dyed flame resistant fabric of claim 18, wherein said inherently flame resistant fibers are essentially composed of a material selected from the group consisting of aromatic polyamide, polyamide imide, polyimide, and mixtures thereof.

20. The dyed flame resistant fabric of claim 18, wherein said inherently flame resistant fibers are meta-aramid fibers.

21. The dyed flame resistant fabric of claim 18, wherein said cellulosic fibers are essentially composed of rayon, acetate, triacetate, lyocell, or mixtures thereof.

22. The dyed flame resistant fabric of claim 18, wherein said cellulosic fibers are rayon fibers.

23. The dyed flame resistant fabric of claim 18, wherein said dyed flame resistant fabric contains a residual amount of dye-assistant that remains in said fibers after said fabric has been dyed, said dye-assistant being selected from the group consisting of N-cyclohexylpyrrolidone, benzyl alcohol, N,N-dibutylformamide, and mixtures thereof.

24. The dyed flame resistant fabric of claim 18, wherein said inherently flame resistant fibers of said fabric have been dyed a shade of color which would result in an L value between approximately 18 and the greige L value for said fabric approximately if said inherently flame resistant fibers were used to form a fabric composed exclusively of said inherently flame resistant fibers.

25. A dyed flame resistant fabric comprising:

a plurality of inherently flame resistant fibers; and a plurality of cellulosic fibers containing a flame retardant compound;

wherein said inherently flame resistant fibers of said fabric have been dyed a shade of color which would result in an L value between approximately 18 and the greige L value for said fabric approximately if said inherently flame resistant fibers were used to form a fabric composed exclusively of said inherently flame resistant fibers;

wherein said flame retardant is a phosphorus compound contained in said fabric in a concentration of at least approximately 1.4% phosphorus by weight of cellulosic fiber component after 100 launderings conducted in accordance with NFPA 1975, 1994 ed., s. 4-2.4;

wherein said dyed flame resistant fabric exhibits a duration of afterflame no greater than 2.0 seconds when subjected to a vertical flammability test conducted in accordance with FTMS 191A Method 5903.1 using a three second exposure after previously being subjected to 100 launderings in accordance with NFPA 1975. 1994 ed., s. 4-2.4;

wherein said dyed flame resistant fabric exhibits a shrinkage percentage of no greater than approximately 7% after 20 launderings conducted in accordance with AATCC Test Method 135-1992, Table I (3)(V)(A)(iii).

26. The dyed flame resistant fabric of claim 25, wherein said inherently flame resistant fibers and said cellulosic fibers contain a residual amount of a dye-assistant that remains in said fibers after said fabric has been dyed, said dye-assistant being selected from the group consisting of N-cyclohexylpyrrolidone, benzyl alcohol, N,N-dibutylformamide, and mixtures thereof.

27. The dyed flame resistant fabric of claim 25, wherein said inherently flame resistant fibers are essentially composed of a material selected from the group consisting of aromatic polyamide, polyamide imide, polyimide and mixtures thereof.

28. The dyed flame resistant fabric of claim 25, wherein said inherently flame resistant fibers are meta-aramid fibers.

29. The dyed flame resistant fabric of claim 25, wherein said cellulosic fibers are essentially composed of rayon, acetate, triacetate, lyocell, or mixtures thereof.

30. The dyed flame resistant fabric of claim 25, wherein said cellulosic fibers are rayon fibers.

* * * * *